US009470493B2

(12) United States Patent
Thuman et al.

(10) Patent No.: US 9,470,493 B2
(45) Date of Patent: Oct. 18, 2016

(54) METHOD FOR COMBATING EXPLOSIVE-CHARGED WEAPON UNITS, AND PROJECTILE DESIGNED FOR THE SAME

(71) Applicant: BAE Systems Bofors AB, Karlskoga (SE)

(72) Inventors: Christer Thuman, Karlskoga (SE); Kjell Wallberg, Degerfors (SE); Carin Vorde, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 71 days.

(21) Appl. No.: 14/452,978

(22) Filed: Aug. 6, 2014

(65) Prior Publication Data

US 2015/0300795 A1 Oct. 22, 2015

Related U.S. Application Data

(62) Division of application No. 13/504,729, filed as application No. PCT/SE2010/000262 on Oct. 28, 2010, now Pat. No. 8,826,823.

(30) Foreign Application Priority Data

Oct. 30, 2009 (SE) ..... 0901393

(51) Int. Cl.
*F42B 12/44* (2006.01)
*F42B 12/46* (2006.01)
(Continued)

(52) U.S. Cl.
CPC ..... *F42B 12/74* (2013.01); *F42B 12/36* (2013.01); *F42B 12/44* (2013.01); *F42B 12/46* (2013.01)

(58) Field of Classification Search
CPC ..... F42B 12/02; F42B 12/36; F42B 12/362; F42B 12/44; F42B 12/46; F42B 12/74
USPC ..... 102/363, 364, 402, 403, 516, 517; 86/50; 89/1.13
See application file for complete search history.

(56) References Cited

U.S. PATENT DOCUMENTS 3,401,636 A 9/1968 Ciccone et al.
3,745,077 A 7/1973 Jones
(Continued)

FOREIGN PATENT DOCUMENTS

DE 10115950 C1 6/2002
GB 2400163 A 10/2004

OTHER PUBLICATIONS

Written Opinion issued in Application No. 201203033-4 dated Jul. 11, 2013.
(Continued)

*Primary Examiner* — James S Bergin
(74) *Attorney, Agent, or Firm* — Polsinelli PC

(57) ABSTRACT

The invention relates to a method of, with a projectile (1) comprising a reactive charge (4), combating an explosive-charged weapon unit (7), preferably an enemy shell, so that undesirable harmful effects on the environment are reduced, wherein the projectile (1) is configured to penetrate the surface (8) of the weapon unit (7) upon impact so that a passage (9) is opened into the explosive (10) of the weapon unit (7), through which passage (9) the reactive charge (4), under the influence of the kinetic energy of the projectile (1), is transferred to the explosive (10) of the weapon unit (7). The method can be deemed to be characterized in that the reactive charge (4), upon contact with the explosive (10) of the weapon unit (7), reacts and starts a hypergolic reaction with the explosive (10). The invention also relates to a projectile (1) for the said method.

6 Claims, 2 Drawing Sheets

Figure 1:
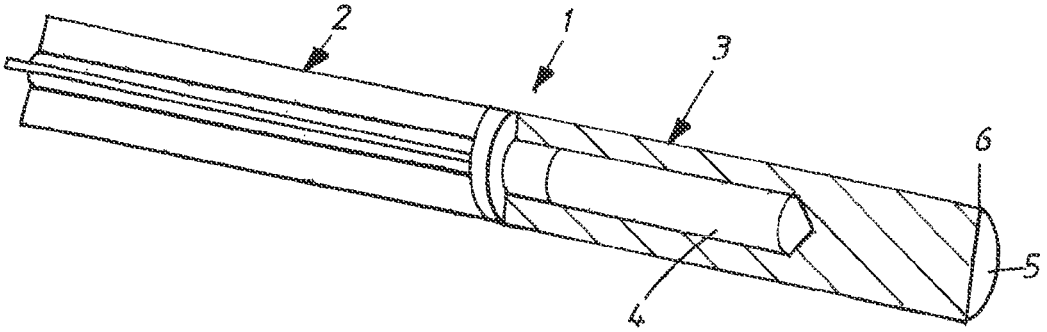

(51) Int. Cl.
*F42B 12/74* (2006.01)
*F42B 12/36* (2006.01)

(56) References Cited

U.S. PATENT DOCUMENTS

| | | | | |
|---|---|---|---|---|
| 4,383,485 | A | 5/1983 | Coates et al. | |
| 4,419,936 | A | 12/1983 | Coates et al. | |
| 4,493,260 | A | 1/1985 | Foster | |
| 4,712,465 | A | 12/1987 | Macdonald | |
| 4,955,939 | A | 9/1990 | Petrousky et al. | |
| 5,936,184 | A | 8/1999 | Majerus et al. | |
| 6,341,551 | B1 * | 1/2002 | Comeyne | F41H 11/136 86/50 |
| 6,354,222 | B1 | 3/2002 | Becker et al. | |
| 6,371,219 | B1 | 4/2002 | Collins et al. | |
| 6,401,591 | B1 | 6/2002 | Ross et al. | |
| 6,546,838 | B2 | 4/2003 | Zavitsanos et al. | |
| 6,679,176 | B1 | 1/2004 | Zavitsanos et al. | |
| 6,691,622 | B2 | 2/2004 | Zavitsanos et al. | |
| 6,748,842 | B1 | 6/2004 | Guirguis | |
| 8,075,715 | B2 | 12/2011 | Ashcroft et al. | |
| 8,122,833 | B2 | 2/2012 | Nielson et al. | |
| 8,485,099 | B2 | 7/2013 | Skidmore et al. | |
| 8,635,957 | B2 | 1/2014 | Orlev et al. | |
| 8,826,823 | B2 * | 9/2014 | Thuman | F42B 12/46 102/364 |
| 9,182,199 | B2 * | 11/2015 | Skidmore | F42B 12/44 |
| 2003/0051629 | A1 | 3/2003 | Zavitsanos et al. | |
| 2009/0308272 | A1 | 12/2009 | Schroeder et al. | |

OTHER PUBLICATIONS

Jimmie C. Oxley et al., "Hypergolic Reaction of TNT", Propellants, Explosives, Pyrotechnics, Oct. 2009, vol. 34, Issue 5, pp. 421-426, published online Sep. 23, 2009, abstract.

Written Opinion of the International Searching Authority for PCT/SE2010/000262; Apr. 2012.

Brandon Hill: "US Navy Announces "Venom Penetrator" Countermine Projectile", Jan. 25, 2007. Retrieved from the Internet: URL:http//www.dailytech.com/US+Navy+Announces+Venom+Penetrator+Countermine+ Projectile/article5838.htm.

Supplementary European Search Report issued Dec. 12, 2014 in EP Appln No. 10827227.

* cited by examiner

METHOD FOR COMBATING EXPLOSIVE-CHARGED WEAPON UNITS, AND PROJECTILE DESIGNED FOR THE SAME

CROSS REFERENCE TO RELATED APPLICATIONS

This application is a Divisional of co-pending application Ser. No. 13/504,729 filed on Jul. 2, 2012, which is a National Phase filing under 35 U.S.C. §371 of PCT/SE2010/000262 filed on Oct. 28, 2010; and this application claims priority to Application No. 0901393-9 filed in Sweden on Oct. 30, 2009 under 35 U.S.C. §119; the entire contents of all are hereby incorporated by reference.

TECHNICAL FIELD

The present invention relates to a method of, with a projectile comprising a reactive charge, combating an explosive-charged, weapon unit, preferably an enemy shell, so that undesirable harmful effects on the environment are reduced.

The invention is especially intended for combating explosive-charged shells, but can also relate to missiles or other combatable weapon units, such as, for example, bombs, home-made explosive devices or air, water or ground craft comprising explosives, etc., whereby, in projectiles configured according to the invention, the explosive of the combatable weapon unit is initiated by means of projectiles with reactive charge aimed at this explosive at high speed.

It is previously known that an explosive can be made to detonate by the shock effect which is generated by a splinter when it hits the explosive at high speed. It is also known that a pressure wave from an explosive charge can initiate the detonation of an explosive. This knowledge has been utilized, inter alia, in the design of projectiles intended to combat enemy explosive-charged shells or missiles.

One problem with the said methods for use in combating explosive-charged shells or other explosive-charged weapon units is the damage which the detonation, in the form of a pressure wave and splinter effect from the detonation, causes to the environment, whereby civil material, and humans are put at risk.

US 2003051629 A1 discloses a method and a projectile for combating an explosive-charged weapon unit. The projectile in US 2003051629 A1 comprises a reactive mixture consisting of a metal and an oxidizer. The reactive mixture is capable after initiation, when the projectile penetrates the explosive-charged weapon unit, of initiating the explosive of the weapon unit.

AIMS OF THE INVENTION AND ITS DISTINGUISHING FEATURES

One object of the present invention is a simplified method of, with a projectile, combating an explosive-charged weapon unit, preferably an enemy shell, so that undesirable harmful effects on the environment are minimized.

A further object of the present invention is a simplified projectile with fewer components, designed for the said combat operation.

The said objects, as well as other aims which are not listed here, are satisfactorily met by that which is specified in the present independent patent claims.

Embodiments of the invention are specified in the dependent patent claims.

Thus, according to the present invention, a simplified method has been produced of, with a projectile comprising a reactive charge, combating an explosive-charged weapon unit, preferably an enemy shell, so that undesirable harmful effects on the environment are reduced. The projectile is configured to penetrate the surface of the shell upon impact so that a passage is opened into the explosive of the shell, through which passage the reactive charge is transferred to the explosive of the shell under the influence of the kinetic energy of the projectile.

The method is characterized in that the reactive charge, upon contact with the explosive, reacts and starts a hypergolic reaction with the explosive.

According to further aspects of the method according to the invention:

- the reactive charge is disposed in at least one gas-tight and liquid-tight container in the action part to prevent contact between the reactive charge and the surrounding air, especially during storage, transport and handling.

In addition, according to the present invention, a projectile has also been produced, comprising a reactive charge for combating an explosive-charged weapon unit, for example an enemy shell, which projectile is configured such that undesirable harmful effects on the environment are minimized, the projectile being configured to penetrate the surface of the shell upon impact so that a passage is opened into the explosive of the reactive charge for transfer of the reactive charge. The projectile is characterized in that the reactive charge comprises at least one substance which reacts with the explosive and starts a hypergolic reaction.

According to further aspects of the projectile, according to the invention:

- the reactive charge comprises zinc or zinc stearate or mixtures thereof,
- the reactive charge comprises porous and granulated zirconium, fine-grained magnesium perchlorate and bismuth trioxide,
- the reactive charge is liquid and comprises pyrrolidine,
- the reactive charge is disposed in at least one gas-tight and liquid-tight container in the action part to prevent leakage of liquid substances to the environment, especially during handling, storage and transport,
- the gas-tight and liquid-tight container is constituted by an all-covering metal foil for preventing undesirable reactions with the surrounding atmosphere.

Advantages and Effects of the Invention

The invention enables explosive-charged weapon units to be combated effectively, without this causing any serious damage to the environment, e.g. to civil material and humans.

The use of projectiles having non-explosive reactive charge also increases safety during handling, storage and transport of the projectiles.

Storage of the reactive charge in gas-tight and liquid-tight containers in the projectile simplifies handling and increases safety during production, storage, transport and fitting of the reactive charge in projectiles, especially when the reactive charge exists in gaseous or liquid form. The quantity and type of reactive charge can easily be varied. The risk of leakage during long-term storage and during transportation is reduced.

The small number of component parts allows simple configuration of the projectile, which makes it suitable for mass production and which also means low unit price.

The invention thus offers an opportunity to markedly reduce the projectile size necessary to combat an explosive-charged weapon unit, and thus the overall size of the particular weapon system and costs of the same.

The invention has been defined in the following patent claims and will now be described in somewhat greater detail in connection with the appended figures.

Figure 2:
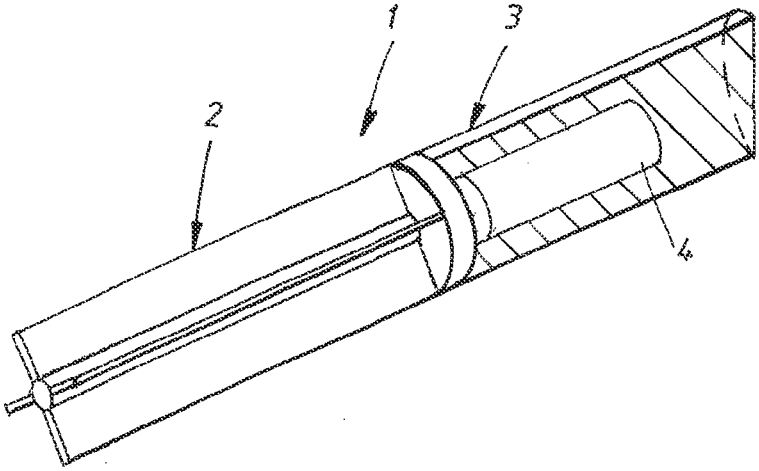
Figure 3:
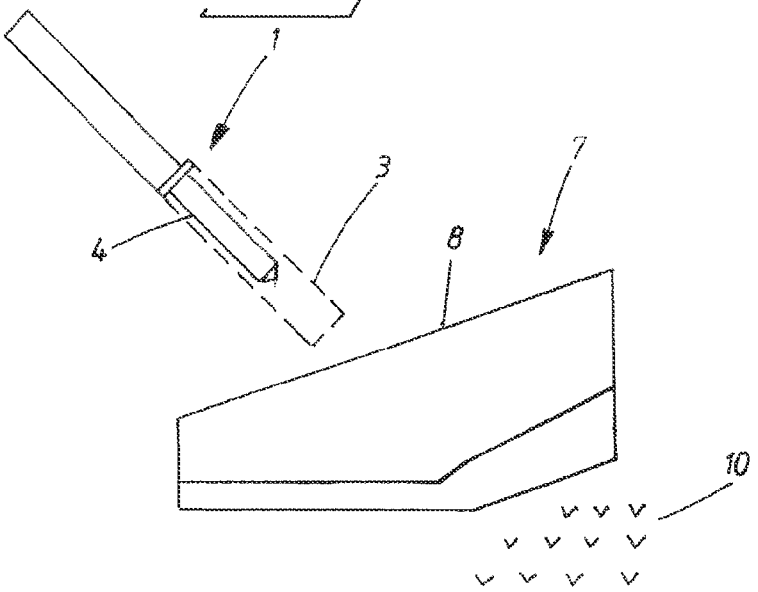
Figure 4:
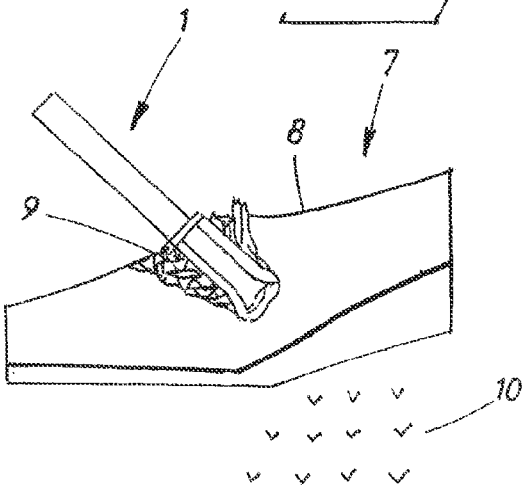
Figure 5:
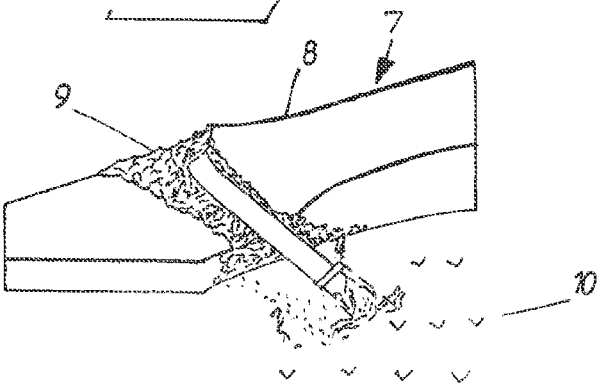

Further advantages and effects will emerge in the course of study and consideration of the following, detailed description of the invention, with simultaneous reference to the appended drawing figures, in which:

FIG. 1 shows schematically a side view of a projectile, viewed obliquely from the front, in which the front part of the projectile is sectioned in the longitudinal direction, wherein the placement of the reactive charge of the projectile is evident, FIG. 2 shows schematically a side view of a projectile according to FIG. 1, viewed obliquely from the rear, FIG. 3 shows schematically a projectile according to FIG. 1 with 45° angle of attack, immediately prior to penetration of a weapon unit, FIG. 4 shows schematically a projectile according to FIG. 1 immediately following penetration of a weapon unit, FIG. 5 shows schematically a projectile according to FIG. 1, following completed penetration of a weapon unit, a passage having been opened into the explosive.

DETAILED DESCRIPTION CF EMBODIMENTS

FIGS. 1 and 2 show a projectile 1, in which the front part of the projectile 1 is constituted by an action part 3 and the rear part thereof by a fin part 2. Preferably, the action part 3 is constituted by a rotationally symmetric body, for example in the form of a rod or cylinder of circular cross section. Other embodiments, of triangular or square cross section, for example, can also be used. The action part 3 is fitted directly onto the fin part 2 of the projectile 1 by, for example, threading, gluing, screwing or shrinkage. Alternatively, the action part 3 can be fitted onto an intermediate assembly part (not shown) between the action part 3 and the fin part 2. The fin part 2 of the projectile 1, FIGS. 1, 2, is constituted by a homogeneous plastics part with fins, preferably moulded. The plastic can be replaced with other materials, for example metal.

The action part 2 comprises a reactive charge 4, whose composition and configuration is such that, upon contact with an explosive 10, for example TNT, it reacts spontaneously (compare hypergolic reaction), whereupon deflagration of the explosive is initiated and the explosive is burnt without detonating.

The reactive charge 4 is disposed in at least one gas-tight and liquid-tight cavity in the action part 3 of the projectile 1. The cavity is preferably cylindrical and extends through the majority of the action part 3 in the longitudinal direction of the projectile. In a special embodiment, the reactive charge 4 is disposed in one or more gas-tight and liquid-tight containers in the cavity (not shown in the figures). The use of gas-tight and liquid-tight containers presents a number of advantages, for example easy handling of reactive charge 4 in the loading of projectiles 1.

Furthermore, the risk of leakage during storage and transport is reduced. The gas-tight and liquid-tight containers can have various shapes and sizes, but are preferably cylindrical and equal in size so as to fit easily into the cylindrical cavities. The gas-tight and liquid-tight containers enable the quantity and type of reactive charge 4 to be easily varied with regard to the aimed-for desired effect.

Instead of gas-tight and liquid-tight containers, the cavity of the action part 3 can be configured with one or more gas-tight and liquid-tight chambers, in which one or more reactive charges are disposed.

The reactive charge 4 comprises substances which, upon contact with an oxygen sensor and/or a fuel, for example air or an explosive 10, self-ignites and starts a deflagration.

High requirements are placed on a projectile 1 in order for it to penetrate the steel casing 8 of the weapon unit 7 so that a passage 9 is opened into the explosive 10. FIGS. 3-5 show a sequence in which a projectile 1 penetrates a weapon unit 7, for example an enemy shell, at high speed and with an oblique impact angle. FIG. 3 shows the projectile 1 immediately prior to impact, before penetration has commenced. FIG. 4 shows the projectile 1 immediately following impact, when a small part of the steel casing 8 of the shell 7 has been penetrated.

FIG. 5 shows the projectile 1 after the steel casing 8 of the shell 7 has been penetrated and a passage 9 has been opened into the explosive 10. Once a passage 9 has been opened, the reactive charge 4 is transferred to the explosive 10 through the effect from the kinetic energy of the projectile 1. When the reactive charge 4 is mixed with the explosive 10, a reaction with the explosive 10 occurs, whereupon the explosive 10 is burnt by deflagration. Gas which is formed in the course of the burning generates an overpressure inside the weapon unit 7, which leads to splitting and destruction of the weapon unit 7.

The reactive charge 4 comprises a mixture of reactive substances, also termed hypergolic substances, which, upon contact with the explosive 10 of the weapon unit, react spontaneously. Solid hypergolic substances which can advantageously be used in the reactive charge 4 are zinc and zinc stearate and mixtures thereof, a suitable mix ratio being 99% by weight zinc and 1% by weight zinc stearate.

Further examples of solid hypergolic substances are: porous granulated zirconium, fine-grained magnesium and mixtures of magnesium perchlorate and bismuth trioxide, preferably 60% by weight magnesium perchlorate and 40% by weight bismuth trioxide. Solid hypergolic substances of the said type are pressed into suitable shape to fit into the cavity of the projectile, preferably in the shape of a rod or cylinder. Other solid reactive substances which can be included are, for example, lithium or potassium or mixtures thereof.

Liquid hypergolic substances which can advantageously be included are: pyrrolidine, diethylenetriamine (DETA) and ethylenediamine. Of these, pyrrolidine is the most advantageous. Liquid hypergolic substances require, however, precise isolation/enclosure in the projectile 1 in order to prevent leakage and undesirable reactions with substances in the environment. A comprehensive isolation/enclosure can be constituted, for example, by an all-covering plastics or metal foil.

For the penetration of the shell 7, the configuration of the action part 3 of the projectile 1 is of particular importance, the configuration of the front of the projectile being especially important. The choice of material in the action part 3 and in its casing is also of great importance in order to obtain a surface which is as hard and dimensionally stable as possible so as thereby to increase the penetrability of the projectile 1. For example, the casing of the action part 3 can comprise one or more hard metals, for example tungsten or tungsten carbide. In order to avoid a situation in which the projectile 1, upon impact, slides on the surface 8 of the shell 7, especially in the event of shallow angles of attack, it is advantageous if the front 5 of the action part 3 is plane with a sharp edge 6. In order to further improve the fastening or adhesion to the surface 8, it is advantageous if the edge 6 comprises some form of fastening parts, such as barbs. For example, the edge 6 can be serrated.

In a special embodiment, a propulsive device (not shown) is arranged behind the reactive charge 4 in the action part 3. The propulsive device is preferably constituted by a metal body, which presses the reactive charge 4 before it into the weapon unit 7 via the passage 9, under the influence of the kinetic energy of the projectile. Alternatively, the propulsive device, in response to an activation signal, can itself generate a propulsive force behind the reactive charge 4.

The propulsive device is expediently configured as a movably arranged metal body directly behind the reactive charge 4, for example in the form of a piston, which, under the influence of the weight of the metal body, presses the reactive charge 4 before it during the penetration process. The metal body expediently comprises a heavy metal with high specific weight, for example lead or uranium.

Alternatively, the propulsive device is configured as a pyrotechnic charge, which, upon initiation, generates a gas pressure behind the reactive charge 4, which gas pressure presses the reactive charge 4 before it.

Any other configuration which fulfils the characteristics distinctive of the invention is, however, possible. The invention is thus not limited to shown embodiments, but can be varied in different ways within the scope of the patent claims. It will be appreciated, for example, that the combat target which is specifically described herein, i.e. the shell 7 specified in the illustrative embodiments, can also be comprised by any other air, water or ground target containing an explosive 10 which can be initiated according to the patent claims. It will further be appreciated that, as indicated earlier, the serrated profile of the edge can be replaced by, for example, a bevel along that edge of the action part 3 which penetrates the weapon unit 7. Other edge profiles are also possible. It will also be appreciated that the number, size, material and shape of the elements and parts belonging to the projectile 1, for example the action part 3, the reactive charge 4, containers for the reactive charge 4 and any propulsive devices, are adapted to other component elements and parts and to the enemy target or targets which the projectile 1 is intended to combat.

What is claimed is:

1. A projectile comprising a reactive charge for combating an explosive-charged weapon unit, which projectile is arranged such that undesirable harmful effects on the environment are minimized, wherein the projectile is configured to penetrate the surface of the shell upon impact so that a passage is opened into the explosive of the weapon unit, for transfer of the reactive charge, wherein the reactive charge comprises at least one substance which, upon contact with the explosive of the weapon unit, reacts with the explosive and starts a hypergolic reaction, and wherein the reactive charge comprises a mixture of zinc and zinc stearate pressed in the form of a rod, which, upon contact with the explosive of the weapon unit, reacts with oxygen in the explosive.

2. The projectile according to claim 1, wherein the mixture of zinc and zinc stearate comprises 99 weight % zinc and 1 weight % zinc stearate.

3. The projectile according to claim 1, wherein the reactive charge is disposed in at least one gas-tight and liquid-tight container in the projectile to prevent leakage.

4. The projectile according to claim 3, wherein the gas-tight and liquid-tight container is constituted by an all-covering metal foil.

5. The projectile according to claim 3, wherein the reactive charge is disposed in at least one gas-tight and liquid-tight container in the projectile to prevent leakage during handling, storage and transport.

6. The projectile according to claim 1, which comprises a movable metal body arranged behind the reactive charge, which metal body under the influence of its weight presses the reactive charge before it during the penetration process into the weapon unit via the passage.

* * * * *